US006668412B1

(12) United States Patent
Tadros et al.

(10) Patent No.: US 6,668,412 B1
(45) Date of Patent: Dec. 30, 2003

(54) CONTINUOUS PRESTRESSED CONCRETE BRIDGE DECK SUBPANEL SYSTEM

(75) Inventors: Maher K. Tadros, Omaha, NE (US); Sameh Samir Badie, Omaha, NE (US); Mantu C. Baishya, Omaha, NE (US)

(73) Assignee: Board of Regents of University of Nebraska, Lincoln, NE (US)

( * ) Notice: Subject to any disclaimer, the term of this patent is extended or adjusted under 35 U.S.C. 154(b) by 0 days.

(21) Appl. No.: 09/085,802

(22) Filed: May 27, 1998

Related U.S. Application Data

(60) Provisional application No. 60/047,891, filed on May 29, 1997.

(51) Int. Cl.[7] ..... F16D 1/00; E01D 19/06

(52) U.S. Cl. ..... 14/73.1; 14/73; 403/229

(58) Field of Search ..... 14/73, 74, 77.1, 14/78, 73.1; 52/726.1, 566; 403/229, 300, 314, 392, 393, 28, 29, 30; 404/47, 51, 49, 50, 52

(56) References Cited

U.S. PATENT DOCUMENTS 1,542,492 A * 6/1925 Cluett
1,763,369 A * 6/1930 Robertson ..... 404/134
1,807,364 A * 5/1931 White ..... 404/134
1,977,496 A * 10/1934 Snyder et al.
2,043,571 A * 6/1936 Bargreen ..... 404/51
2,265,301 A * 12/1941 Meyer et al.
2,278,023 A * 3/1942 Robertson ..... 404/51
2,725,612 A * 12/1955 Lipski ..... 264/228
3,126,671 A * 3/1964 Nagel
3,238,856 A * 3/1966 Jahn
3,245,190 A * 4/1966 Reiland ..... 52/649.3
3,343,858 A * 9/1967 Rice
3,570,207 A * 3/1971 Launay
3,608,048 A * 9/1971 Lipski ..... 264/228
3,785,741 A * 1/1974 Lodige ..... 404/51
3,850,535 A * 11/1974 Howlett et al. ..... 403/305
3,899,261 A * 8/1975 Mieville ..... 404/68
4,245,923 A * 1/1981 Rieve ..... 404/70
4,300,320 A * 11/1981 Rooney ..... 52/173 R
4,306,395 A * 12/1981 Carpenter ..... 52/223
4,319,855 A * 3/1982 Huber et al. ..... 404/68
4,332,504 A * 6/1982 Arai ..... 404/68
4,397,579 A * 8/1983 Goldman et al. ..... 404/60
4,493,177 A * 1/1985 Grossman ..... 52/745
4,604,841 A * 8/1986 Barnoff et al. ..... 52/174
4,612,751 A * 9/1986 Gloppen et al. ..... 52/723
4,617,219 A * 10/1986 Schupak ..... 428/113
4,709,456 A * 12/1987 Iyer ..... 29/155 R
4,799,307 A * 1/1989 Reigstad et al. ..... 29/452
4,883,385 A * 11/1989 Kaler ..... 404/47
4,953,280 A * 9/1990 Kitzmiller ..... 29/412
4,968,176 A * 11/1990 Balach ..... 403/393
4,972,537 A * 11/1990 Slaw, Sr. ..... 14/1
5,720,067 A * 2/1998 Grearson ..... 14/73
5,850,653 A * 12/1998 Mufti ..... 14/73
5,867,855 A * 2/1999 Kim ..... 17/77.1
5,978,997 A * 11/1999 Grossman ..... 14/73

OTHER PUBLICATIONS

Brochure of Prestress Supply Incorporated, of Lakeland, Florida, 4 pp., entitled "S.I.P.™ Bridge Panel System".

* cited by examiner

*Primary Examiner*—Robert E. Pezzuto
*Assistant Examiner*—Raymond W Addie
(74) *Attorney, Agent, or Firm*—Shook, Hardy & Bacon LLP

(57) ABSTRACT

A prestressed concrete panel for a bridge construction includes a first section having at least one tension member extending therethrough. A second section of the panel is spaced from the first section to form a gap therebetween. The tension member extends through the second section also and across the gap. The gap is adapted to be aligned above a support beam or girder. At least one compression member also extends between the first and second sections and across the gap in such a manner such that the gap is maintained against the tension forces of the tension member.

22 Claims, 7 Drawing Sheets

22
28
26
38
36
54
9.
19.
12.
10.
11.
56
68
74
42
72
66
50
52
60
70
48

22
23
21
28
34
40
100
102
104
106
38
32
42
50
66
76
80
82
84
30
26
112
108
110
114
116
118
120

CONTINUOUS PRESTRESSED CONCRETE BRIDGE DECK SUBPANEL SYSTEM

CROSS REFERENCE TO RELATED APPLICATIONS

This application claims the benefit of U. S. Provisional Application No. 60/047,891, filed May 29, 1997.

STATEMENT REGARDING FEDERALLY-SPONSORED RESEARCH OR DEVELOPMENT

Not applicable.

BACKGROUND OF THE INVENTION

This invention relates to a subpanel system for bridge deck construction, and, more particularly, to a subpanel system that is prestressed in the transverse direction, and continuously connected in the longitudinal direction.

A great majority of bridges constructed in the United States utilize a concrete deck slab. A major disadvantage of utilizing concrete slabs is the deterioration of the concrete bridge deck and the need for rapid replacement of the deck. A number of different bridge constructions have been developed over the years for new bridge construction or for rehabilitation of deteriorated bridge decks.

A first of these construction systems is a full-depth, cast-in-place bridge deck system. This system involves the casting of the entire bridge deck in place utilizing wood forms constructed at the bridge construction site. The bridge deck is generally cast as a one piece full-depth structure. This type of construction system suffers from numerous serious disadvantages. First and foremost is the speed with which a bridge deck can be constructed. More specifically, creation of wood forms for the pouring of the bridge deck oftentimes is very labor intensive and time consuming. This is especially true in the edge portions of the bridges where an overhang extends beyond the edge of the nearest support girder or beam. In addition, due to the length of time required to install such forms and thereafter pour the concrete, the. forms generally are expensive to utilize. More specifically, they require great labor to set up the form and to thereafter remove the form from the bridge deck. In addition to speed and cost concerns, anytime the entire structure is poured in place, there can become serious questions of the quality of the entire bridge deck. As is apparent, the knowledge and skill of workmen in addition to various weather factors can affect the quality of the concrete poured throughout the transverse and longitudinal sections of the bridge deck. Additionally, such full-depth, cast-in-place systems oftentimes do not offer a realistic approach to rehabilitation of deteriorated bridge decks.

A second type of bridge deck system is the full-depth prefabricated deck system. As the name suggests, this involves entirely prefabricated deck panels which are positioned in place above bridge girders to form the deck system. There generally is little or no concrete pouring involved in constructing a bridge deck of this type. The main advantage associated with these prefabricated deck systems is that construction time is reduced, and the forming required for casting is eliminated. However, again, this type of system has serious drawbacks. First of all, because the entire depth is a prefabricated item, adjacent decks of the system are riot easily adjusted with respect to one another. Additionally, to create a smooth upper surface, substantial amounts of grinding are required between adjacent panels to increase the ride and quality of the bridge structure. Further, oftentimes it is necessary to longitudinally post-tension the prefabricated structures to control transverse joint cracking. Still furthermore, support beams and girders must have a special type of shear connector arrangement to fit into the pockets formed on the underside of the prefabricated bridge deck panels.

A still further type of bridge deck construction system involves a combination of a cast-in-place deck and a stay-in-place precast concrete panel. More specifically, most of these systems involve providing a thin solid precast prestressed panel to rest on top of the support beams or girders and to operate as a form for a cast-in-place layer placed on top of the prestressed panels. The panels are generally three to four inches in thickness and are produced in four to eight feet widths depending upon the available transportation and lifting equipment. The precast panels that form the base layer of such structure are butted against one another without any continuity between them. More specifically, nothing is utilized to connect the panels together as they rest adjacently on the reinforcing beams in both the transverse and longitudinal direction. This combination bridge If deck system suffers from numerous drawbacks. Although this system offers advantages in the form of prestressing in the individual panels themselves, the system still suffers from serious disadvantages. More specifically, because there is no way to support a prestressed concrete panel adjacent an edge girder to form a bridge overhang, it is still necessary to use forming structures adjacent the bridge edge to form such overhangs, thus resulting in the cost and labor intensive practices associated with such forms. Additionally, constructing a bridge deck can require the placement of numerous precast prestressed panels. More specifically, it could be required to place as many as three to four panels to transverse the width of the bridge structure with additional transverse rows necessary to cover the longitudinal length of the bridge. Each of these panels must be placed with precision, thus increasing the labor hours and costs of placing the panels. Additionally, a problem associated with precast prestressed concrete subpanels is reflective cracking during use. More specifically, it has been found that after travel over a bridge deck, cracks develop in the upper cast-in-place topping which outline the subdeck prestressed concrete panels. The reflective cracking is generally due to the lack of continuity in both the longitudinal and transverse directions. It has further been found that because of the lack of continuity between layers, if a bridge is to fail under loads, it will often fail adjacent a support girder or beam due to the shear stresses associated at such locations, caused by lack of continuity of the steel reinforcement at such locations.

A bridge deck construction is needed which alleviates the problems associated with the prior art as discussed above.

SUMMARY OF THE INVENTION

Accordingly, it is an object of the present invention to provide a bridge deck construction which is more cost-effective and simpler to construct.

Another object of the present invention is to provide a bridge deck construction which allows for excellent field quality in construction, and, further, offers long-term durability of the bridge deck.

A further object of this invention is to provide a bridge deck construction which eliminates the need for field forming to create deck overhangs.

A still further object of the invention is to create a bridge construction precast panel system which is able to support paving machine and construction loads in additional to self weight such that there is no need to support an overhang during the casting of a topping slab.

A still further object of the present invention is to provide a bridge deck construction which eliminates the need to handle a large number of pieces and the need to precisely position the subdeck panels onto the support beams or girders.

A still further object of the present invention is to provide a subdeck system that eliminates reflective cracking.

Another object of the present invention is to provide a bridge deck construction that does allow for significant flexibility in placement of shear connectors on beams or girders.

A still further object of the present invention is to provide a bridge deck system that has superior performance than conventional prestressed panel systems under cyclic load.

Another object of the present invention is to provide a bridge deck system which has immensely increased failure load capacity over the conventional subdeck prestressed panel systems.

A still further object of the present invention is to provide a precast panel which can. be crowned during forming such that the crowning will be achieved across the transverse direction of the bridge.

Accordingly, the present invention provides for a prestressed concrete panel for bridge construction including a first section having at least one tension member extending therethrough. A second section is spaced from the first section and forms a gap therebetween. The tension member extends through the second section and across the gap. The gap is adapted to be aligned above a support beam. At least one compression member extends between the first and second sections in such a manner as to maintain the gap against the tension forces of the, tension member.

The present invention further provides for a connecting assembly adapted to connect adjacent panels of a bridge deck construction. Each panel has a reinforcing member therethrough with at least one exposed end. The assembly includes a splice member overlapping the exposed end of each reinforcing member of the adjacent panels. A locking member surrounds a splice member and the exposed end.

The present invention still further provides a method of producing a crowned prestressed concrete panel, including putting an elongated member into tension, thereafter deforming the elongated member from a linear path, thereafter pouring a concrete mixture around the tension elongated member and into a form that generally follows the deformed path of the elongated member. Thereafter, allowing the concrete mixture to cure and releasing the tension on the elongated member.

Additional objects, advantages, and novel features of the invention will be set forth, in part, in a description which follows, and in part will become apparent to those skilled in the art upon examination of the following, or may be learned by practice of the invention.

DETAILED DESCRIPTION OF THE PREFERRED EMBODIMENTS

Figure 1:
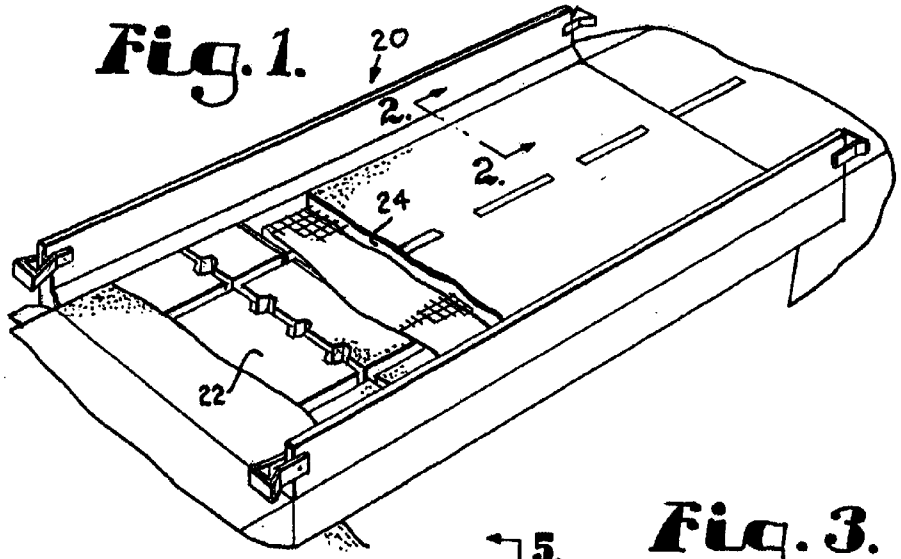
FIG. 1 is a top perspective view of a bridge deck construction according to the present invention, parts being broken away to reveal details of construction.
Figure 2:
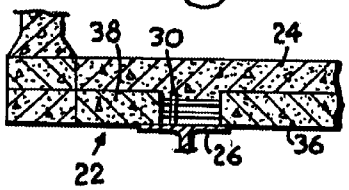
FIG. 2 is a cross-sectional view taking generally along line 2—2 of FIG. 1.
Figure 6:
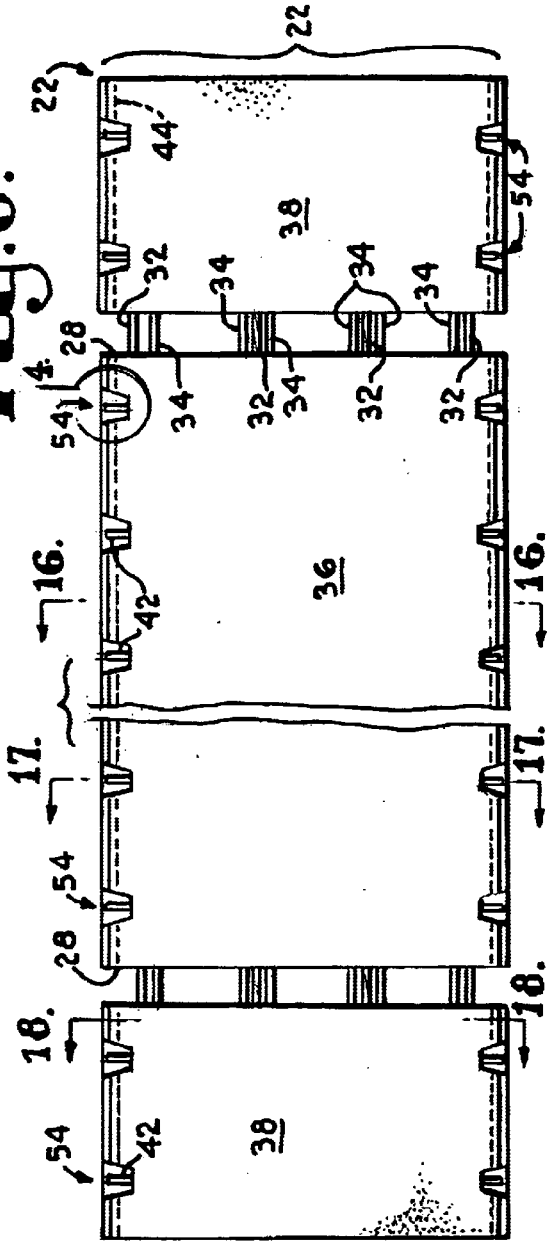
FIG. 6 is a top plan view of a subdeck panel according to the present invention after it has been formed, but prior to placement on bridge support members.
Figures 7, 8, 9, 10:
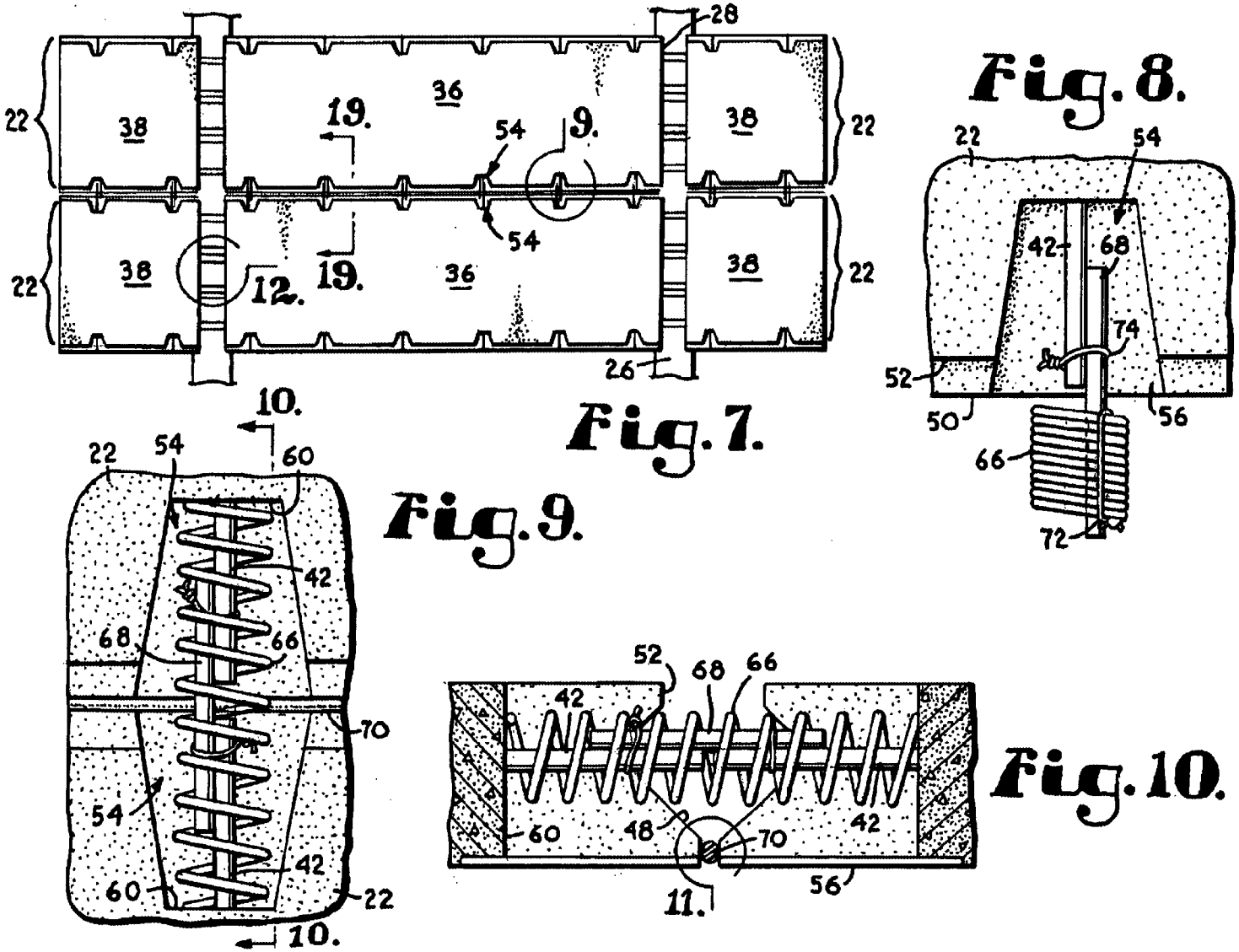
FIG. 7 is a top plan view of two subdeck panels placed on a bridge support structure and connected together, prior to a topping slab being poured.
FIG. 8 is a top plan view similar to FIG. 4, showing an intermediate step in connecting subpanels longitudinally together.
FIG. 9 is an enlarged view of the area designated generally by the numeral 9 in FIG. 7, showing the longitudinal connecting structure between adjacent panels, prior to the pouring of the topping slab.
FIG. 10 is a cross-sectional view taken generally along line 10—10 of FIG. 9.
Figure 13:
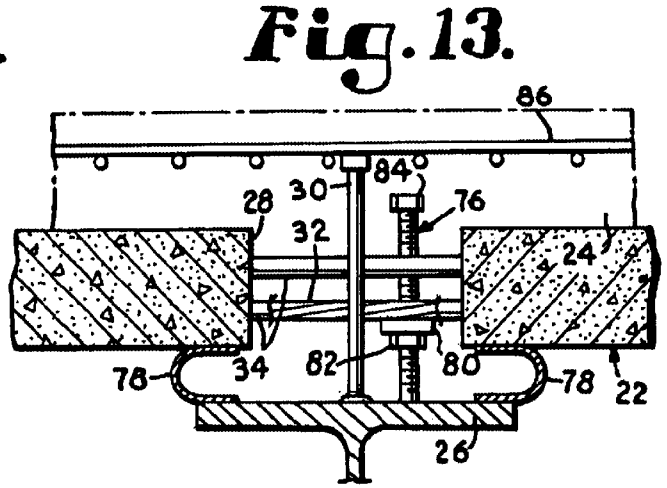
FIG. 13 is a cross-sectional view taken generally along line 13—13 of FIG. 12.
Figure 14:
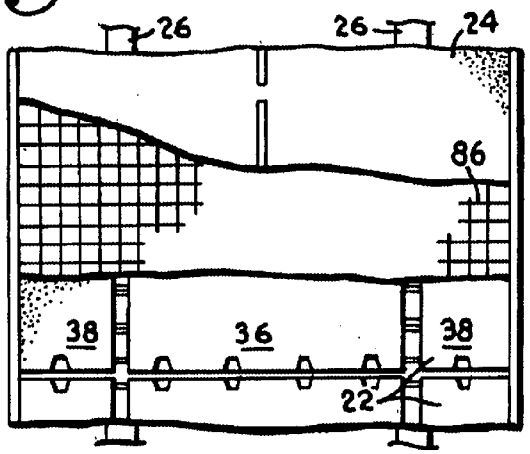
FIG. 14 is a top plan view of the bridge deck construction of FIG. 1, parts being broken away to reveal details of construction.
Figure 12:
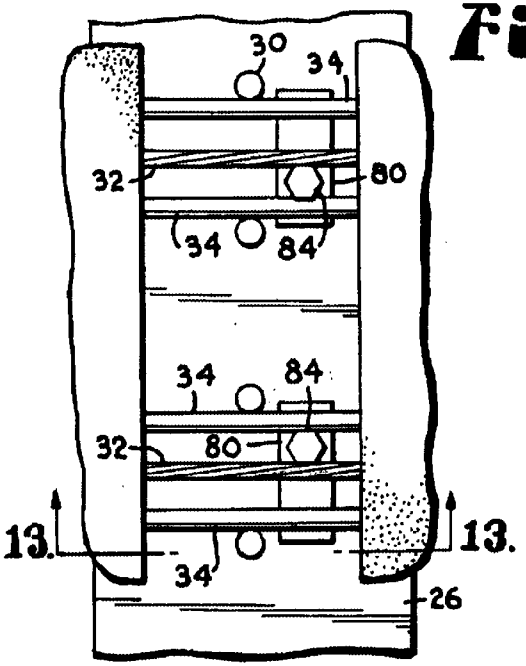
FIG. 12 is an enlarged view of the area designated generally by the numeral 12 in FIG. 7 and showing the positioning of the subpanel gaps above the support members of the bridge construction.

Referring to the drawings in greater detail, and initially to FIGS. 1 and 14, a bridge deck construction designated generally by the reference numeral 20 is shown. Bridge construction 20 includes a plurality of prestressed precast concrete panels 22 and a cast-in-place concrete topping 24. Panels 22 form the subdeck of the bridge construction and are positioned on top of the beams or girders 26 in a manner that will be more fully described below. Topping 24 forms the roadway surface upon which vehicles will travel. With reference to FIGS. 6 and 7, each panel 22 is formed such that it extends across the entire width of the bridge construction. At the girder positions of the bridge, full length gaps 28 are provided. Gaps 28 allow accommodation of shear connectors 30 which extend upwardly and are fixedly attached to girders 26 as best shown in FIGS. 12 and 13. As can be best. seen in FIG. 12, a plurality of shear connectors 30 are aligned along girder 26 and, further, extend into the respective gap 28 above girder 26.

Figure 3:
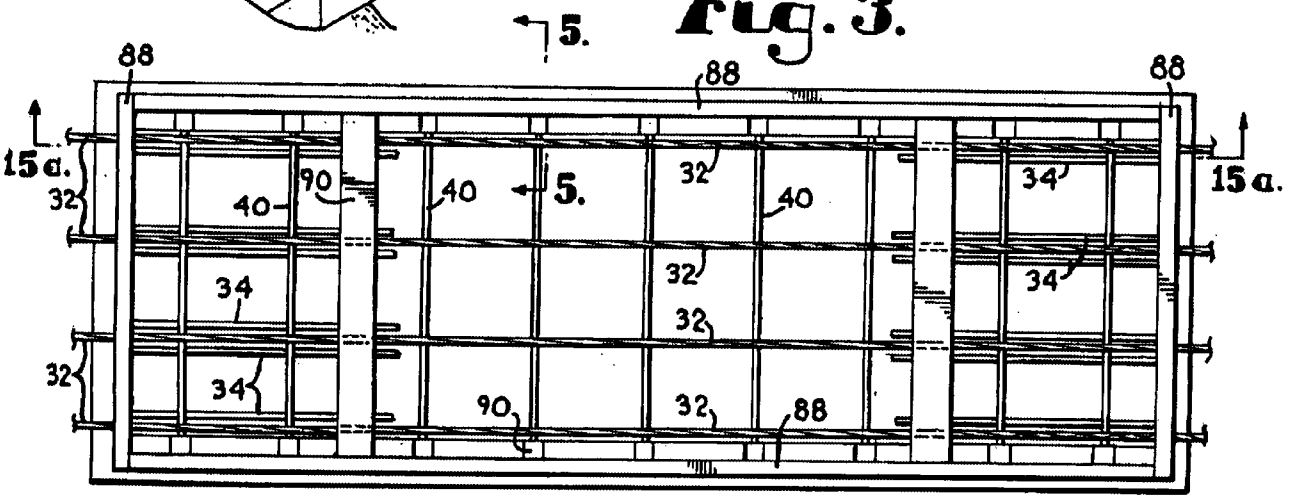
FIG. 3 is a top plan view of the forming of a panel according to the present invention, showing the positioning of tension members, compression members and longitudinal reinforcing members within the panel, prior to concrete being poured into the form to form a panel.
Figure 16:
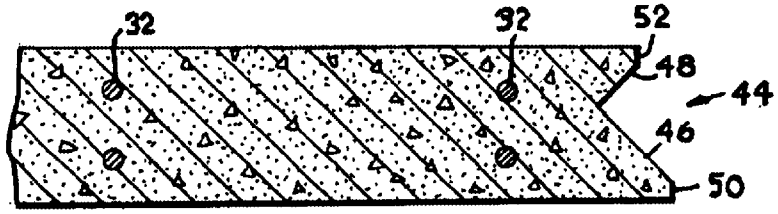
FIG. 16 is a cross-sectional view taken generally along line 16—16 of FIG. 6.
Figure 17:
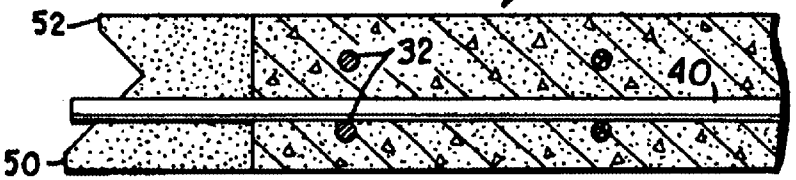
FIG. 17 is a cross-sectional view taken generally along line 17—17 of FIG. 6.
Figure 18:
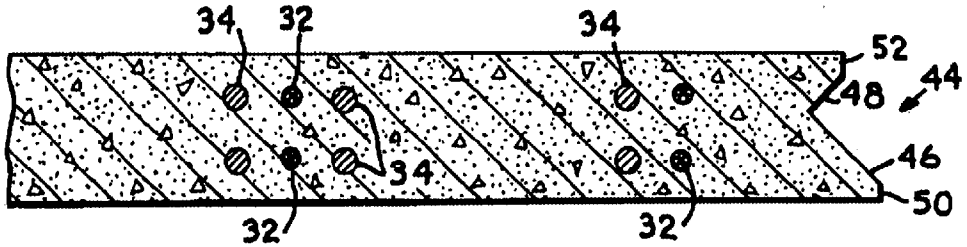
FIG. 18 is a cross-sectional view taken generally along line 18—18 of FIG. 6.

Each panel 22 is pretensioned from end to end utilizing a plurality of wire strands 32 as best shown in FIGS. 3, 6 and 16–18. Strands 32 are provided in two layers through the height of panel 22 and are uniformly spaced across the width of panel 22, as best shown in FIGS. 3, 6 and 18. Each strand 32 extends substantially the full length of each panel 22, including the distance across gaps 28. Strands 32 provide for pretensioning of panels 22 in a manner as will be described below. Extending across each of the gaps 28 is also a plurality of compression bars 34. Bars 34 are embedded in adjacent concrete sections of panels 22 and serve to transmit the prestressing force from one section to another section over the gaps 28. Bars 34 are also positioned in two layers, as best shown in FIG. 18. Other compressive structure could be used in addition to or in place of bars 34. For example, concrete pillars extending across gaps 28 could be used as compressing members.

As shown in FIGS. 6, and 7, each panel 22 has three different sections. More specifically, there is a middle section 36 and overhang sections 38 on each end. Sections 38 form the overhang portion of a bridge deck. The prestressing strands 32 extending throughout the length of the panel 22 allows the supporting of overhang sections 38 in a cantilevered fashion from the nearest support girder. Thus, as is apparent, the need for utilizing expensive forming structures to construct overhang sections is avoided.

Although the panel 22 shown in the figures has three sections, any number of sections can be utilized, depending upon the width of the bridge deck and the number of girders needed to support it. For example, a bridge having a width of 44 feet would consist of three 12-foot middle sections plus two 4-foot overhang sections 38. Such a bridge construction would have four supporting steel girders and four gaps formed with each panel. The width of panels 22 could preferably vary from four feet to twelve feet, depending upon the transportation and lifting, equipment available, although other widths could be feasible. It has been found suitable to form panel 22 with a 4.5 inch height and out of high-strength concrete with a specified concrete release strength of 4.0 ksi, and a 28-day compressive strength of 10.0 ksi. Further, it has been found suitable to utilize one half inch low relaxation strands of 270 ksi as strands 32. Still further, a suitable spacing for strands 32 is 12 inches, and the minimum concrete cover over the strands with relation to the nearest top or lower surface has been found to be one inch. Additionally, a suitable dimension for gap 28 has been found to be eight inches for a twelve-inch girder. Bars 34 are preferably #6 reinforcing bars and are generally embedded into the adjacent sections of each panel to a depth of 18 inches.

Figure 19:
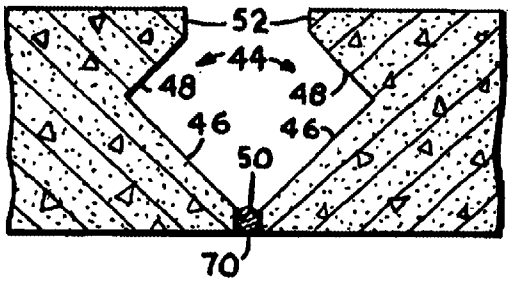
FIG. 19 is a cross-sectional view taken generally along line 19—19 of FIG. 7.

Each panel 22, in addition to transverse strands 32 and compression bars 34, has reinforcing longitudinal bars 40, as best shown in FIGS. 3, 6 and 17. Bars 40 are equally spaced along the width of each panel 22 and have exposed ends 42 along each edge. Additionally, along each edge of panel 22 is a transverse extending a channel 44 with a generally diamond-shaped cross section, as best shown in FIGS. 16, 18 and 19. Channel 44 extends from one end of each panel to the other end (as best shown in FIG. 6) and is generally asymmetrical such that the bottom planar surface 46 of channel 44 extends outwardly beyond the upper planar surface 48. In this manner, a lower transverse edge 50 is formed which juts out beyond the upper transverse edge 52.

Figure 5:
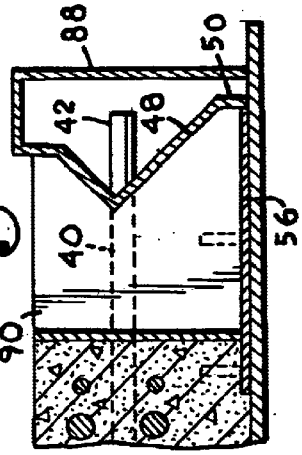
FIG. 5 is a cross-sectional view taken generally along 5—5 in FIG. 3 showing the forming of the transverse channel of the panel and also the connecting pockets of the panel, concrete having already been poured into the form shown in FIG. 3.
Figure 4:
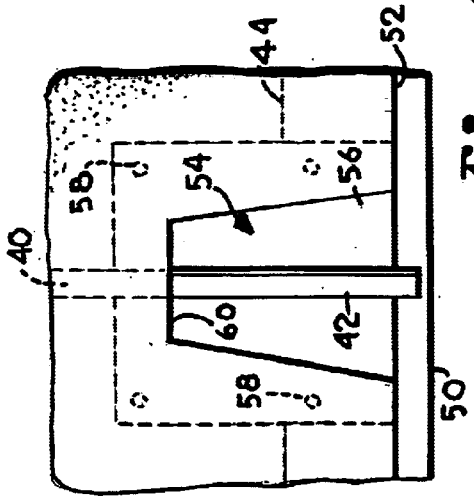
FIG. 4 is an enlarged view of the area generally designated by the numeral 4 in FIG. 6, and shows the construction of a pocket along a transverse edge of a panel.

Disposed at spaced intervals along both transverse edges of the panel is a plurality of pockets 54, as best shown in FIGS. 4 and 6. Pockets 54 are formed adjacent the exposed ends 42 of bars 40. Each pocket 54 is formed of a generally trapezoidal shape which is open at the top and closed at the bottom. The closure at the bottom is formed by a metal plate 56. Plate 56 is utilized in forming pockets 54 and remains a part of panel 22. Plates 56 have dovetail or protrusion portions 58 which extend upwardly into the concrete of panels 22 to ensure that plate 56 is attached in position. Plate 56 has a generally rectangular. shape along the bottom surface adjacent the pockets 54, as best shown in FIGS. 4, 5. and 17. The general shape of pockets 54 is such as to form a trapezoidal, three-dimensional figure positioned on its side with a rear wall 60, bottom wall formed by plate 56, and an open top and an open front. Exposed ends 42 of bars 40 terminate at a horizontal location that is approximately above lower transverse edge 50, as best shown in FIG. 4.

Figure 11:
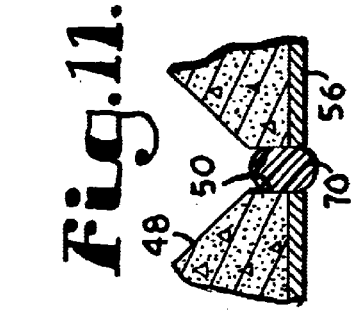
FIG. 11 is an enlarged view of the area designated generally by the numeral 11 in FIG. 10.

The structure of channel 44, pockets 54, and exposed ends 42 allow for continuity in the longitudinal direction between adjacent panels 22. More specifically, as best shown in FIGS. 7, 9, and 10, two adjacent panels 22 are positioned next to one another such that their gaps 28 and pockets 54 align. As a result of this positioning, exposed ends 42 of adjacent panels are generally in line with one another, but not touching one another. A connection between the exposed ends of adjacent panels is accomplished by utilizing an expandable spiral connecting member or coil 66 and a splice segment or rod 68. As shown in FIGS. 9 and 10, rod 68 overlaps both the exposed ends 42 of adjacent panels 22. Spiral member 66 surrounds both exposed ends 42 and splice rod 68, and is expanded in aligned pockets 54 such that the ends of the spiral member 66 engage the rear walls 60 of adjacent pockets. Also positioned between adjacent panels 22 is a backer rod 70 made of a foam or rubber-type compressible material. Rod 70 generally is compressed between transverse lower edges 50 of adjacent panels, as best shown in FIGS. 11 and 19. The purpose of backer rod 70 is to provide a seal along the lower ends of adjacent channels 44, such that when topping 24 is poured along the top surface of panels 22, the concrete from topping 24 will flow into channels 44 and pockets 54 to surround spiral members 66 and splice rod 68 to create a continuous splice between adjacent panels after the concrete of topping 24 cures. Additionally, the shape of channels 44 serve as a lock against shear forces between adjacent panels. More specifically, the material flowing within the channels extends inwardly to the interior of adjacent panels such that shear forces applied between the panels will be resisted. The general diamond-shape of channel 44 can be conveniently molded, but other shapes that extend into the interiors of the panels along the edge may be appropriate.

With reference to FIG. 8, the method of installing spiral member 66 and splice rod 68 is shown. More specifically, after one panel 22 is in place on a bridge support structure, a compressed spiral member 66 is positioned along the exposed ends 42 of one edge. Spiral 66 is held in this compressed state by a tie wire 72. Thereafter, a second panel 22 is lowered adjacent to the panel 22 with compressed spiral members 66, and a backer rod 70 is placed between the lower edges 50 of the adjacent panels. Thereafter, a splice rod 68 is overlapped over adjacent exposed ends 42 and tied thereto via tie wire 74. After this is done, tie wire 72 is cut and spiral member 66 expands between the adjacent pockets 54.

It has been found suitable to construct longitudinal bars 40 of a #4 bar and to construct plate 56 of a 20-gauge, generally square piece of sheet metal. Suitable spacing for the pockets 54 and bars 40 is approximately two feet. Splice rod 68 can also be formed of a #4 bar.

With reference to FIGS. 12 and 13, a leveling device 76 and grout stoppers 78 will be described. To level the panels on the supporting girders 26, a simple leveling device 76 is utilized. The leveling device consists of a plate 80, having an aperture therein, to which is welded a nut 82. A bolt 84 is received through the aperture in plate 80 and through nut 82. Plate 80 is mounted between the top flange of the girder and the lower layer of bars 34. At least two assemblies are provided in each gap, and can be utilized to adjust the level of the panel simply by applying a torquing force to bolts 84. Before panels 22 are positioned on support girders 26, grout barriers 78 are installed along the girder flange edges, as best shown in FIG. 13. Grout barriers 78 generally are formed of a light. gauge metal and have a U-shape that extends along the length of gaps 28. The upper portion of grout barrier 78 is positioned along the lower surface of panel 22, as best shown in FIG. 13. A standard construction adhesive is utilized to attach grout barriers 78 to both girder 26 and the bottom surface of panels 22.

Once the panels 22 are placed over girders 26 and adjusted with leveling devices 76, gaps 28 are thereafter grouted with a flowable mortar mixture to about 1.5 inches below the top surface of the panel 22. The mortar mixture is preferably of a compressive strength of 4.000 psi and 20-day compressive strength. At the time of casting, the mortar provides a compression block needed to resist. negative moment over girders 26 due to loads imposed by concrete paving machines and the self weight of concrete topping 24. It also provides concrete bearing for panels 22 over the girders because the mortar flows under the girders into the U-shaped portions of grout barriers 78.

After panels 22 have been positioned and connected via spiral members 66 and splice rod 68, and grout poured into gaps 28 and allowed to set, cast-in-place concrete topping slab 24 is 5 then poured. Prior to the pouring of slab 24, a wire fabric mesh 86 can be utilized to provide additional reinforcement within slab 24. It has been found suitable to have slab 24 be approximately 4.5 inches in height and wire fabric 86 to be of an epoxy-coated welded type. As discussed above, as topping 24 is poured, the concrete from the topping flows into channels 44 of adjacent panels, and also around spiral member 66 and splice rod 68 to effectuate a longitudinal joint between adjacent panels.

Generally, the construction steps of bridge construction 20 involve first cleaning the surfaces of girders 26. Thereafter, grout barriers 78 are glued along their lower edges to the top surface flange of girders 26. Precast panels 22 are then installed and adjusted with the level devices 76 preattached. The backer rod 70 is positioned between adjacent panels to prevent leakage during the casting of the cast-in-place topping slab 24. Thereafter, gaps 28 are filled with the flowable mortar mix or rapid set nonshrink grout to a height that is approximately 1.5 inches below the top surface of the precast panel. Thereafter, splice rods 68 are installed, and spiral members 66 are released from their compressed position by cutting tie wires 72. Wire fabric 86 is thereafter installed along the top surface of panels 22 and topping slab 24 is cast in place and cured.

General design of bridge construction 20 is accomplished utilizing AASHTO Standard Specifications 16th Edition. The design procedure consists of two different sections: (1) the precast panel, and (2) the composite section. The precast panel is designed to support precast panel self weight, topping slab 24 self weight, a construction load of 50 lbs. per square feet, and the loads provided by the concrete paving machine. The composite section (the subpanels 22 and topping slab 24) is designed to support the superimposed dead loads of a two-inch concrete wearing surface, barrier self weight and live loads. An HS25 truckload is considered as the live load. This is equivalent to AASHTO HS20 loading magnified by a factor of 1.25. A New Jersey barrier type, of 330 lbs. per foot self weight, is considered.

For the design of precast panel 22, two stages were considered: (1) release of prestress; and (2) casting of topping slab 24. At release stage, compatibility and equilibrium equations are applied at the section at the gap to calculate the compressive stresses gained in bars 34, and tensile stress lost in prestressing strands 32. Therefore:
Where:

| | |
|---|---|
| $\epsilon$ | = the elastic strain loss in the gap |
| $f_{pi}$ | = tensile stress in the strands just before release<br>= 0.75 × 270 = 202.5 ksi (1396 MPa) |
| A, | = the cross section area of the reinforcing bars<br>= 28 × 0.44 = 12.32 in$^2$ (7948 mm$^2$) |
| $A_p$ | = the cross section area of the prestressing strands<br>= 16 × 0.153 = 2.448 in$^2$ (1579 mm$^2$) |
| E, | = the Modulus of Elasticity of the reinforcing bars<br>= 29,000 ksi (200 × 10$^3$ MPa) |
| $E_p$ | = the Modulus of Elasticity in the prestressing strands<br>= 28,000 ksi (193 × 10$^3$ MPa) |

Therefore:

$$\varepsilon = \frac{2{,}448 \times 202.5}{12.32 \times 29{,}000 + 2.448 \times 28{,}000}$$

$$= 1.164 \times 10^{-3} \text{ in./in.}$$

Compression stress in the reinforcing bars $$=\epsilon(E,)$$

$$=(1.164\times10^{-3})(29{,}000)=33.76 \text{ ksi (233 MPa)}$$

Tensile stress in the prestressing strands $$=f_{pi}-\epsilon(E_p)$$

$$=202.5-(1.164\times10^{-3})\ (28{,}000)$$

$$=169.91 \text{ ksi (1171 MPa)}$$

Similar analysis at the midspan between the girder lines needs to be conducted to determine the tensile stresses in the prestressing strands at that location. This is needed for the positive moment design. Calculations show that this value is in the range of 191 ksi.

Reinforcing bars 34 and gaps 28 must be adequate to satisfy two design criteria: (1) preserve as: much prestress in the strands as possible; and (2) transfer the prestresses to the adjacent concrete without too much stress concentration. The first criterion was already covered above. Satisfaction of the second criterion is not totally clear to the inventors. A conservative approach is to use the tension development length as the minimum required embedment into the concrete. However, this may be an "overkill" as the bars are expected to be predominantly in compression and the end bearing is totally ignored. The suitable 18-inch embedment mentioned above is not too wasteful in terms of the overall cost of the system. The buckling length of bars 34 at the gap is also checked to protect these bars from buckling.

At topping slab 24 casting stage, three sections are checked: (1) maximum positive moment section between girders 26 under the self weight of precast panels 22 and topping slab 24 and construction load; (2) maximum negative moment section at interior supports under the self weight of precast panel 22, topping slab 24, and the construction load; and (3) maximum negative moment section at the exterior support under the self weight of precast panel 22, topping slab 24, the construction load, and the concentrated loads provided by the concrete paving machine. For the maximum positive moment section the service concrete stresses and the ultimate flexure capacity of precast panels 22 are checked. For the maximum negative moment sections, the ultimate flexural capacity was checked.

With reference to FIGS. 3 and 5, the forming of panels 22 will be generally described. Wood forms 88 can be used to form the general shape of panels 22, and, further, to form channels 44 in the transverse edges of panel 22. Polystyrene foam 90 and plate 56 are utilized to form pockets 54. Additionally, polystyrene foam or wood forming can be used to form gaps 28 between adjacent sections of each panel 22. It should be noted, however, that in commercial production, steel forms may be preferable to form all the above structures. The production sequence of panels 22 is first to assemble wood side forms 88 to form the shape of panels 22. Thereafter, the lower layer of strands 32 are installed and tensioned to 0.8 fpu. (Note that 0.05 fpu is considered for jacking losses). The lower layer of bars 34 is then installed. Thereafter, longitudinal bars 40 were installed at the pocket locations through polystyrene foam forms 90. Metal plates 56 were then installed in their position adjacent each pocket 54. The upper layer of strands 32 is then installed and tensioned to 0.8 fpu. Thereafter, the upper layer of bars 34 is installed. Concrete is then cast and vibrated and the top surface of the panel is roughened utilizing a silk brush to a height of approximately 0.5 inches. The concrete is cured using wet burlap for ten continuous days. A torch cut is utilized to release strands 32. It is believed that smooth surfaced strands 32 may be desirable to avoid possible cracking upon release of the tension utilizing the torch cut. Additionally, symmetrical release of the forces using torch cut could also be advantageous in eliminating potential cracks.

Testing of bridge construction 20 under a cyclic load has revealed that the structure will have much less cracks than the conventional stay-in-place panel system which is not connected in the transverse and longitudinal. direction. Additionally; reflective cracking in the bridge construction was virtually nonexistent through testing, thus eliminating a flaw in conventional systems that is considered the main reason for corrosion of reinforcing steel and deterioration of a bridge deck slab. Testing of the bridge construction 20 under ultimate load revealed a very ductile behavior of the bridge construction even after failure. Comparison of the behavior of system 20 with conventional stay-in-place panel systems reveals that system 20 has almost double the capacity of the conventional system, has a much more ductile behavior, and has much less deformation. Testing revealed that connecting the panels transversely and longitudinally prevents the steel reinforcement in the cast-in-place topping from corrosion and leads to a better distribution of live load stresses throughout the system.

Bridge construction 20 offers substantial advantages over prior continuous stay-in-place precast prestressed panel. systems, and full-depth cast-in-place systems. More specifically, bridge construction 20 clearly eliminates the need for forming deck overhangs, thus eliminating costs and labor intensive operations that were required in prior art structures. Further, during rehabilitation of bridge decks, construction 20 saves the time needed to rearrange the shear connectors on girders 26 because of the optimized spacing between the reinforcement and the gaps over the girders. The present system further saves substantial amounts of time and labor because panels 22 cover the entire width of the bridge, thus, eliminating the need to handle a large number of pieces as in the case of conventional stay-in-place precast panels. Still further, because panels 22 are designed to support paving machine loads and construction loads, in addition to the self weight and topping slab 24 weight, there is no need to support overhang sections 38 during casting of topping slab 24.

Still further, the longitudinal continuity of the panels via pockets 54, spiral members 66, and splice rod 68 result in longitudinal continuity which results in minimization of reflective cracks at the transverse joints, such cracks being the major reason for failure in prior art systems. The system further provides for superior performance than conventional stay-in-place panel systems under cyclic load, and also has almost double the capacity of conventional stay-in-place panel systems.

Figure 15B:
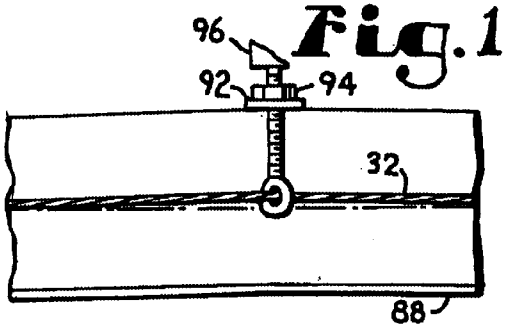
FIG. 15*b* is an enlarged view of the area designated generally by the numeral 15*b* in FIG; 15*a* showing the bridge subdeck panel and a crowing feature of the panel.
Figure 15A:
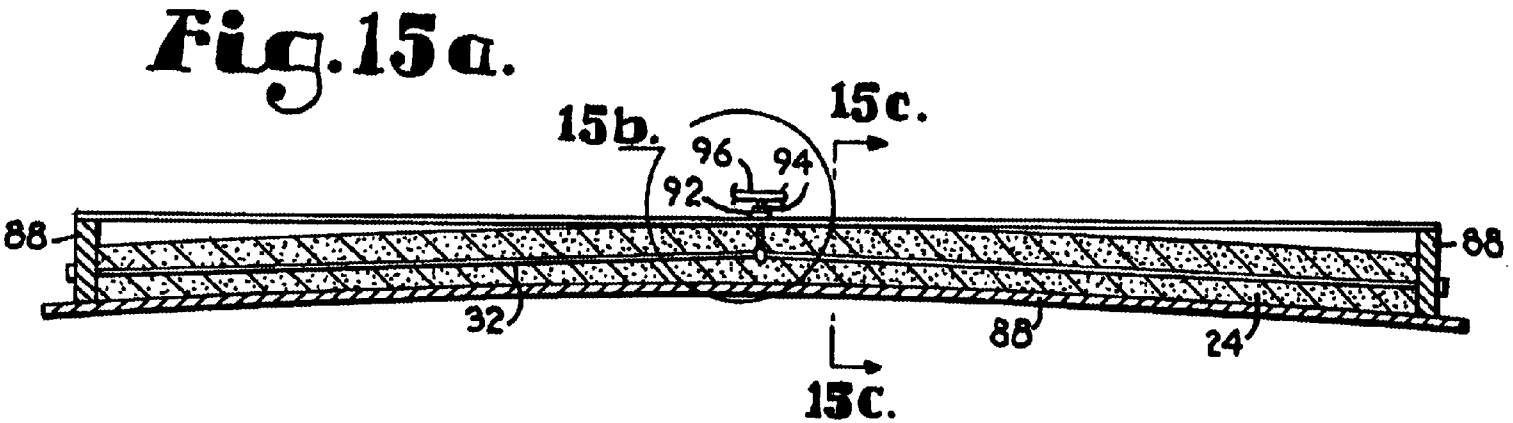
FIG. 15*a* is longitudinal cross-sectional view taken generally long line 15*a*—15*a* of FIG. 3 showing an elongated member in the form of an arc.
Figure 15C:
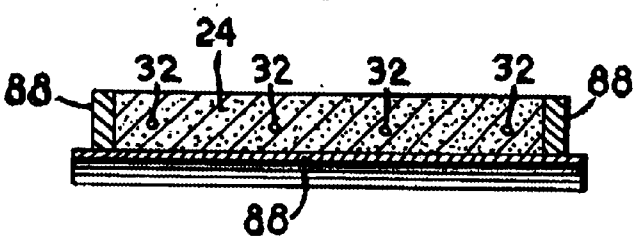
FIG. 15*c* is transverse cross-sectional view taken generally long line 15*c*—15*c* of FIG. 15*a* showing the degree of curvature of a concrete panel.

With reference to FIG. 15, a novel crowning feature of the present invention is shown and will be described. More specifically, during forming of panel 22, it may be desirable to attempt to have the middle more elevated than the edges in a gradual manner such that water will flow toward the end edges of the panels. This can be accomplished by deforming strands 32 prior to pouring panels 22. With reference to FIG. 15, a deforming structure 92 is shown. More specifically, to form a crown structure, a crowned wood form is first built. Thereafter, a strand 32 is put in tension and is deformed at any one of a plurality of locations such that tension strand 32 generally follows the path of the crowned wood form. Deforming structure 92 is attached to fixed structures 96 outside of wood form 88 to allow the deformation. A bolt 94 can be used to adjust the deformation of strands 32. After strands 32 generally follow the crowned path of form 88, concrete can then be poured therein and allowed to cure. The crown structure with the prestressed strands therein will maintain its crown shape because the strand is advantageously positioned in the center of the cross section of the panel. Contrary to instinctive belief, so long as the strand is properly positioned in the cross section, the panel will not attempt to straighten out, and will perform very favorably when put under load. As is apparent, this crowning feature can be utilized in any type of subdeck system, not just the one described above with respect to construction 20 having gaps 28. Deforming structures 92 can be left in the formed panel and cut from the supporting structure 96 utilized outside the wood frame 88.

Figures 20, 21, 22, 23, 24:
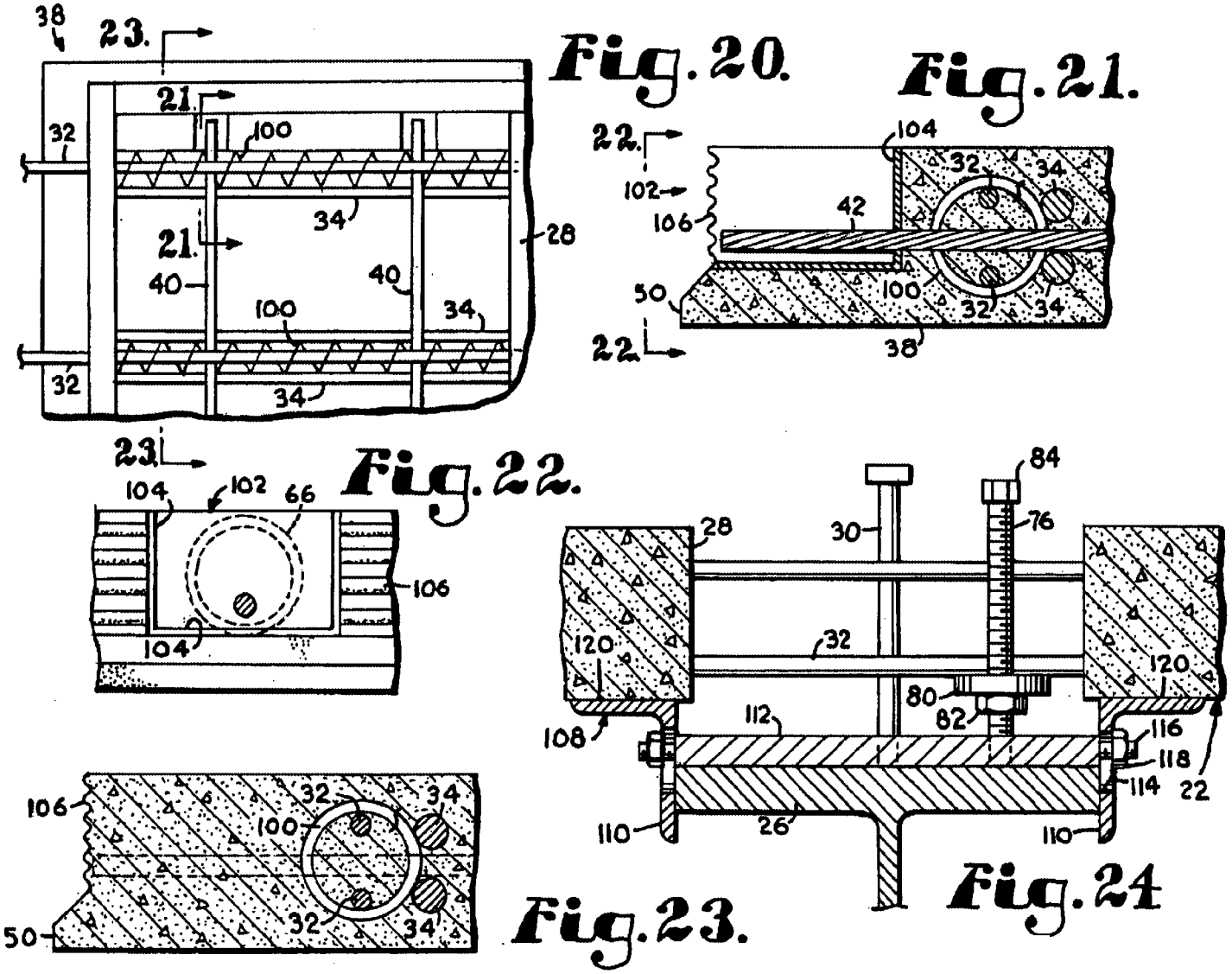
FIG. 20 is a view similar to FIG. 3 showing the position of an alternative prestressing arrangement utilizing an encircling spiral in the overhang section of a panel.
FIG. 21 is a partial cross-sectional view taken generally along line 21—21 of FIG. 20, but showing the overhang section having been poured and formed, and further showing an alternative pocket structure and end surface.
FIG. 22 is a sectional view taken generally along line 20—20 of FIG. 21.
FIG. 23 is a cross-sectional view taken generally along line 23—23 of FIG. 20; but showing a panel poured and formed.
FIG. 24 is a view similar to FIG. 13, but showing an alternative grout barrier arrangement.

With reference to FIGS. 20–23, an alternative structure for reinforcing strands 32 is shown. In particular, in the overhang sections 38 of panel 22, it may be desirable to encircle each of the pairs of strands with a spiral member 100 which extends generally the entire width of section 38 from gap 28; to the edge of overhang section 38, as best shown in FIG. 20. FIG. 20 shows the encircling spiral arrangement prior to the pouring of concrete to form section 38. It has been found advantageous to utilize spiral 100 around strands 32 to increase the tensioning force of the strands adjacent the edges of the overhang sections 38. In particular, in the past, it was found that utilization of the pairs of strands 32 without the coil resulting in a less tensioned area of concrete adjacent the outer edge of overhang 38. The encircling of strands 32 by spiral 100, as shown in FIGS. 21 and 23, has been found to increase the pretensioning in the edge portions of section 38. Coil 100 is preferably a 3-inch outside diameter spiral.

With reference to FIGS. 21 and 22, an alternative pocket structure 102 is shown. In particular, pocket 102 is generally rectangular-shaped and formed by blockout plates 104. Blockout plates 104 extend on the back wall of pocket 102, the side walls of pocket 102, and the bottom wall of pocket 102. Blockout plates 104 can be made of any suitable material, for instance, metal, and can all be formed together in the desired pocket shape. Blockout plates 104 can be positioned in a form prior to forming of a panel and remain in place after such forming. Blockout plates 104 aid in the forming of pockets 102.

With reference to FIGS. 21–23, an alternative to channel 44 is shown. In particular, in place of channel 44, a ridged surface 106 can be utilized. Ridge surface 106 can extend the entire width of each panel 22. Ridge surface 106 serves the same function of channel 44. In particular, when two. panels are butted against one another, topping 24 is poured into the gap formed between the two panels. Once topping 24 hardens, the shape of ridge, surfaces 106 helps resist vertical movement between adjacent panels. As is apparent, ridge surface 106 may be more conveniently formed than channel 44.

With reference to FIG. 24, an alternative grout barrier 108 is shown. Grout barrier 108 includes dual pieces of an angle iron structure, 110, which generally extend in a parallel relationship along the edges of girder 26. Pieces 110 are connected together via a plurality of braces or supports 112 which are spaced at locations along the longitudinal length of pieces 110. Each piece 110 has a slot or equal structure 114 which can be utilized in conjunction with threaded surfaces 116 and nuts 118 of brace 112 to adjust the height to which piece 110 extends above the top surface of girder 26. In particular, each brace 112 holds the pieces 110 in their relative relationship on top of girder 26. To ensure that the engaging surfaces 120 of piece 110 engages the bottom surface of a panel, slots 114, threaded surface 116, and nuts 118 can be utilized to move each of the pieces 110 upward to ensure engagement. As is apparent, this provides an easy adjustable structure to prevent grout from flowing between the girder 26 and the panel 22. It has also been found that it is not necessary to utilize any sort of adhesive or glue to secure grout barriers 108 in position adjacent their girders or the panels.

From the foregoing, it will be seen that this invention is one well-adapted to obtain all the needs and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative, and not in a limiting sense.

We claim:

1. A prestressed concrete panel for bridge construction comprising:

a first section having at least one tension member extending therethrough;

a second section spaced from said first section to form a gap therebetween, wherein said tension member extends through said second section and across said gap, said gap adapted to be aligned above a support member;

at least one compression member extending between said first and second sections in such a manner to maintain said gap against the tension forces of said tension member; and a connecting assembly including a splice member and a locking member, wherein said panel and an adjacent panel have a reinforcing member extending therethrough with at least one exposed end, said splice member overlapping the exposed end of each reinforcing member of the adjacent panels, and said locking member encircling said splice member and said exposed ends.

2. The panel of claim 1 wherein said tensioning member is a metal wire.

3. The panel of claim 1 wherein said compression member is a metal rod.

4. The panel of claim 1 wherein said splice member is a metal rod.

5. The panel of claim 1 wherein said locking member is a coil.

6. The panel of claim 1 wherein a further material layer is cast on top of said sections such the material of said layer flows into said gap.

7. The panel of claim 1 wherein a further material layer is cast on top of the adjacent panels such that the material of said layer surrounds said splice member and said locking member.

8. The panel of claim 1 wherein said tension member and said reinforcing member are perpendicular to one another.

9. The panel of claim 1 wherein said tension member has a spiral member surrounding it.

10. A connecting assembly adapted to connect two adjacent panels of a bridge deck construction, each panel having a reinforcing member therethrough with at least one exposed end, the assembly comprising:

a splice member overlapping the exposed end of each reinforcing member of the adjacent panels; and a locking member surrounding said splice member and said exposed ends.

11. The connecting assembly of claim 10 wherein said splice member is a metal rod.

12. The connecting assembly of claim 10 wherein said locking member is a coil.

13. The connecting assembly of claim 10 wherein a further material layer is cast on top of the adjacent panels such that the material of said layer surrounds said splice member and said locking member.

14. The connecting assembly of claim 10, further comprising a tension member extending through each panel, wherein said tension member and said reinforcing member are perpendicular to one another.

15. The connecting assembly of claim 10 wherein said exposed ends of said reinforcing members are disposed in a cavity formed along the edge of a respective panel.

16. The connecting assembly of claim 15 wherein said cavity extends along the entire length of an end of a respective panel.

17. The connecting assembly of claim 15, wherein said cavity is comprised of the adjacent walls of each adjacent panel extending inwardly, the resulting channel being generally diamond-shaped in a vertical cross section.

18. The connecting assembly of claim 10 wherein a ridged surface extends along the edge of a respective panel.

19. A bridge construction comprising:

at least two concrete panels, each panel having a first section with at least one tension member extending therethrough and a second section spaced from said first section to form a gap therebetween, wherein said tension member extends through said second section and across said gap, said gap adapted to be aligned above a support, each panel having at least one compression member extending between said first and second sections of such panel in such a manner to maintain said gap against the tension forces of said tension member, each panel having a reinforcing member extending therethrough with at least one exposed end, said panels disposed in an adjacent manner such that the exposed ends of the adjacent panels generally align with one another;

a splice member overlapping the exposed end of each reinforcing member of the adjacent panels;

a locking member surrounding said splice member and said exposed ends; and a material cast such that the material surrounds said splice member and said locking member.

20. A method of producing a crowned prestressed concrete panel, said method comprising:

putting an elongated member into tension;

deforming said elongated member from a linear path;

pouring a concrete mixture around said tensioned elongated member and forming the mixture so that it generally follows the deformed path of the elongated member;

allowing said concrete mixture to cure; and releasing the tension on said elongated member.

21. The method of claim 20 wherein said elongated member is a metal wire.

22. The method of claim 20 where said elongated member is in the form of an arc and the concrete mixture is cured in an arcuate form.

* * * * *